US008756943B2

(12) United States Patent
Chen et al.

(10) Patent No.: US 8,756,943 B2
(45) Date of Patent: Jun. 24, 2014

(54) REFRIGERANT CHARGE MANAGEMENT IN A HEAT PUMP WATER HEATER

(75) Inventors: Jie Chen, St. Charles, MO (US); Justin W. Hampton, Bonne Terre, MO (US)

(73) Assignee: Nordyne LLC, O'Fallon, MO (US)

( * ) Notice: Subject to any disclaimer, the term of this patent is extended or adjusted under 35 U.S.C. 154(b) by 26 days.

(21) Appl. No.: 13/548,091

(22) Filed: Jul. 12, 2012

(65) Prior Publication Data

US 2013/0160985 A1 Jun. 27, 2013

Related U.S. Application Data

(60) Provisional application No. 61/578,753, filed on Dec. 21, 2011.

(51) Int. Cl.

| | |
|---|---|
| ***F25B 27/00*** | (2006.01) |
| ***F25D 17/02*** | (2006.01) |
| ***F25B 7/00*** | (2006.01) |
| ***F25B 29/00*** | (2006.01) |
| ***F25B 41/00*** | (2006.01) |
| ***F25B 13/00*** | (2006.01) |

(52) U.S. Cl.

USPC ..... 62/83; 62/238.7; 62/98; 62/79; 62/160; 62/164; 62/196.4; 62/324.4

(58) Field of Classification Search

CPC ..... F25B 13/00; F25B 29/00; F25B 29/003; F25B 30/02; F25B 2313/027; F25B 2313/02731; F25B 2400/004; F25B 2600/2501; F25D 23/12

USPC ..... 62/238.7, 98, 79, 83, 173, 183, 160, 62/164, 196.4, 331, 332, 324.4

See application file for complete search history.

(56) References Cited

U.S. PATENT DOCUMENTS

| | | | |
|---|---|---|---|
| 2,715,317 | A | 8/1955 | Rhodes |
| 2,976,698 | A | 8/1961 | Muffly |
| 3,158,006 | A | 11/1964 | Skeats et al. |
| 3,177,674 | A | 4/1965 | Spofford |

(Continued)

FOREIGN PATENT DOCUMENTS

| | | | |
|---|---|---|---|
| JP | 2006011201 | A | 1/1994 |
| KR | 200309412 | Y1 | 3/2003 |

OTHER PUBLICATIONS

ISR and Written Opinion for corresponding Int'l Application No. PCT/US2012/070271 dated Apr. 24, 2013.

*Primary Examiner* — Frantz Jules
*Assistant Examiner* — Erik Mendoza-Wilkenfel
(74) *Attorney, Agent, or Firm* — Bryan Cave LLP

(57) ABSTRACT

Heat pumps that heat or cool a space and that also heat water, refrigerant management systems for such heat pumps, methods of managing refrigerant charge, and methods for heating and cooling a space and heating water. Various embodiments deliver refrigerant gas to a heat exchanger that is not needed for transferring heat, drive liquid refrigerant out of that heat exchanger, isolate that heat exchanger against additional refrigerant flowing into it, and operate the heat pump while the heat exchanger is isolated. The heat exchanger can be isolated by closing an electronic expansion valve, actuating a refrigerant management valve, or both. Refrigerant charge can be controlled or adjusted by controlling how much liquid refrigerant is driven from the heat exchanger, by letting refrigerant back into the heat exchanger, or both. Heat pumps can be operated in different modes of operation, and segments of refrigerant conduit can be interconnected with various components.

11 Claims, 4 Drawing Sheets

(56) References Cited

U.S. PATENT DOCUMENTS

| | | | | | |
|---|---|---|---|---|---|
| 3,188,829 | A | | 6/1965 | Siewert et al. | |
| 3,200,605 | A | | 8/1965 | Brody | |
| 3,238,737 | A | | 3/1966 | Shrader et al. | |
| 3,301,002 | A | | 1/1967 | McGrath | |
| 3,916,638 | A | | 11/1975 | Schmidt | |
| 3,994,142 | A | | 11/1976 | Kramer | |
| 4,098,092 | A | | 7/1978 | Singh | |
| 4,134,274 | A | | 1/1979 | Johnsen | |
| 4,238,933 | A | | 12/1980 | Coombs | |
| 4,240,269 | A | | 12/1980 | Bussjager | |
| 4,249,390 | A | | 2/1981 | Jones | |
| 4,299,098 | A | * | 11/1981 | Derosier | 62/238.6 |
| 4,399,664 | A | | 8/1983 | Derosier | |
| 4,409,796 | A | | 10/1983 | Fisher | |
| 4,492,092 | A | | 1/1985 | Smorol et al. | |
| 4,493,193 | A | | 1/1985 | Fisher | |
| 4,528,822 | A | | 7/1985 | Glamm | |
| 4,553,401 | A | | 11/1985 | Fisher | |
| 4,598,557 | A | | 7/1986 | Robinson et al. | |
| 4,646,537 | A | | 3/1987 | Crawford | |
| 4,693,089 | A | * | 9/1987 | Bourne et al. | 62/79 |
| 4,765,149 | A | | 8/1988 | Shiga et al. | |
| 4,766,734 | A | | 8/1988 | Dudley | |
| 4,893,476 | A | | 1/1990 | Bos et al. | |
| 4,940,079 | A | | 7/1990 | Best et al. | |
| 4,966,006 | A | | 10/1990 | Thuesen et al. | |
| 5,044,168 | A | | 9/1991 | Wycoff | |
| 5,140,827 | A | | 8/1992 | Reedy | |
| 5,184,472 | A | | 2/1993 | Guilbault et al. | |
| 5,211,029 | A | | 5/1993 | Uselton et al. | |
| 5,261,249 | A | * | 11/1993 | Manz et al. | 62/149 |
| 5,269,153 | A | | 12/1993 | Cawley | |
| 5,465,588 | A | | 11/1995 | McCahill et al. | |
| 5,467,812 | A | | 11/1995 | Dean et al. | |
| 5,495,723 | A | | 3/1996 | MacDonald et al. | |
| 5,653,120 | A | | 8/1997 | Meyer | |
| 5,784,892 | A | | 7/1998 | Reedy | |
| 5,802,864 | A | | 9/1998 | Yarbrough et al. | |
| 5,901,563 | A | | 5/1999 | Yarbrough et al. | |
| 6,253,564 | B1 | | 7/2001 | Yarbrough et al. | |
| 6,286,322 | B1 | | 9/2001 | Vogel et al. | |
| 6,615,602 | B2 | | 9/2003 | Wilkinson | |
| 6,862,894 | B1 | | 3/2005 | Miles | |
| 7,185,505 | B2 | | 3/2007 | Kamimura | |
| 8,056,348 | B2 | | 11/2011 | Murakami et al. | |
| 2004/0182101 | A1 | | 9/2004 | Shimoda et al. | |
| 2005/0016204 | A1 | | 1/2005 | Zhang | |
| 2006/0101838 | A1 | | 5/2006 | Ritchey | |
| 2007/0006602 | A1 | | 1/2007 | Hayashi et al. | |
| 2007/0209380 | A1 | * | 9/2007 | Mueller et al. | 62/260 |
| 2008/0016888 | A1 | | 1/2008 | Kates | |
| 2008/0190130 | A1 | | 8/2008 | Murakami et al. | |
| 2008/0197206 | A1 | | 8/2008 | Murakami et al. | |
| 2008/0245087 | A1 | | 10/2008 | Orcutt | |
| 2008/0307819 | A1 | | 12/2008 | Pham | |
| 2009/0013702 | A1 | | 1/2009 | Murakami et al. | |
| 2009/0049857 | A1 | | 2/2009 | Murakami et al. | |
| 2010/0058791 | A1 | * | 3/2010 | Quesada Saborio | 62/259.1 |
| 2011/0100043 | A1 | * | 5/2011 | Matubara et al. | 62/238.7 |

* cited by examiner

REFRIGERANT CHARGE MANAGEMENT IN A HEAT PUMP WATER HEATER

LICENSE RIGHTS

This invention was made under CRADA NFE-11-03561 between Nordyne and UT-Battelle, LLC, operating and management Contractor for the Oak Ridge National Laboratory for the United States Department of Energy. The Government has certain rights in this invention.

RELATED PATENT APPLICATIONS

This patent application claims priority to Provisional Patent Application No. 61/578,753, filed on Dec. 21, 2011, titled Refrigerant Management for Heat Pump Water Heater, Apparatus and Methods, which has at least one inventor in common with the current patent application and the same assignee. The contents of this priority provisional patent application is incorporated herein by reference. Certain terms, however, may be used differently.

FIELD OF THE INVENTION

This invention relates to heat pumps that heat and cool air and that also heat water, and systems and methods for managing refrigerant charge in such heat pumps.

BACKGROUND OF THE INVENTION

A heat pump is a machine or device that transfers thermal energy from one location, at a lower temperature, to another location, which is at a higher temperature. Accordingly, heat pumps move thermal energy in a direction opposite to the direction that it normally flows. Some types of heat pumps are dedicated to cooling only, some types are dedicated to heating only, and some types perform both functions, for instance, depending on whether heating or cooling is needed at the time. Heat pump HVAC units have been used for some time to heat and cool spaces that people occupy such as the interior of buildings. Heat pumps have also been used for other purposes such as heating water. Heat pumps are typically more efficient than alternative heat sources, such as electrical resistance heating, because heat pumps extract heat from another source, such as the environment, in addition to providing heat produced from the consumption of electrical power. Further, in some situations, the heating and the cooling are both put to beneficial use at the same time, such as heating water while cooling air for air conditioning. As a result, heat pumps often reduce energy consumption in comparison with alternatives.

Heat pumps have been used that heat and cool an enclosed space within a building and that also heat domestic hot water. A problem encountered with such systems, however, is that an appropriate refrigerant charge for one mode of operation has been inappropriate (i.e., insufficient refrigerant charge or excessive refrigerant charge) in another mode of operation. For example, during conditions under which a particular heat exchanger of the heat pump is not needed for transferring heat, liquid refrigerant has accumulated in that heat exchanger reducing the available charge for the system to an inappropriately low level of charge. This has occurred, for example, during conditions under which the outdoor heat exchanger is not needed for transferring heat, while the water is being heated and the space is being cooled. This has also occurred, as another example, during conditions under which the indoor heat exchanger is not needed for transferring heat, while the water is being heated and heat is being extracted from the outdoor air. In the past, it was necessary to correct or compensate for these inappropriate refrigerant charge levels in different modes of operation with complex and expensive refrigerant charge management hardware and systems, or else it was necessary to avoid certain modes of operation such as those modes just mentioned, or the heat pumps operated substantially less efficiently during such modes of operation.

As a result, needs or potential for benefit or improvement exist for refrigerant charge management methods and systems for heat pumps that also heat water that are less expensive, that utilize existing components to a greater extent, that provide for more modes of operation of the heat pump, that increase the efficiency of the heat pump, at least during particular modes of operation, that are less complex, that can be readily manufactured, that are easy to install, that are reliable, that have a long life, that are compact, that can withstand extreme environmental conditions, or a combination thereof, as examples. Further, needs or potential for benefit or improvement exist for methods of controlling, manufacturing, and distributing such heat pumps, HVAC units, buildings, systems, devices, and apparatuses. Other needs or potential for benefit or improvement may also be described herein or known in the HVAC, domestic hot water heater, or heat pump industries, for example. Room for improvement exists over the prior art in these and other areas that may be apparent to a person of ordinary skill in the art having studied this document.

Further background information describing certain aspects of prior art and problems therein includes U.S. Pat. No. 5,140,827, issued to Wayne R. Reedy on Aug. 25, 1992. Potential for benefit exists over the prior art including managing refrigerant charge with fewer components, less expensively, more reliably, or a combination thereof.

Figure 1:
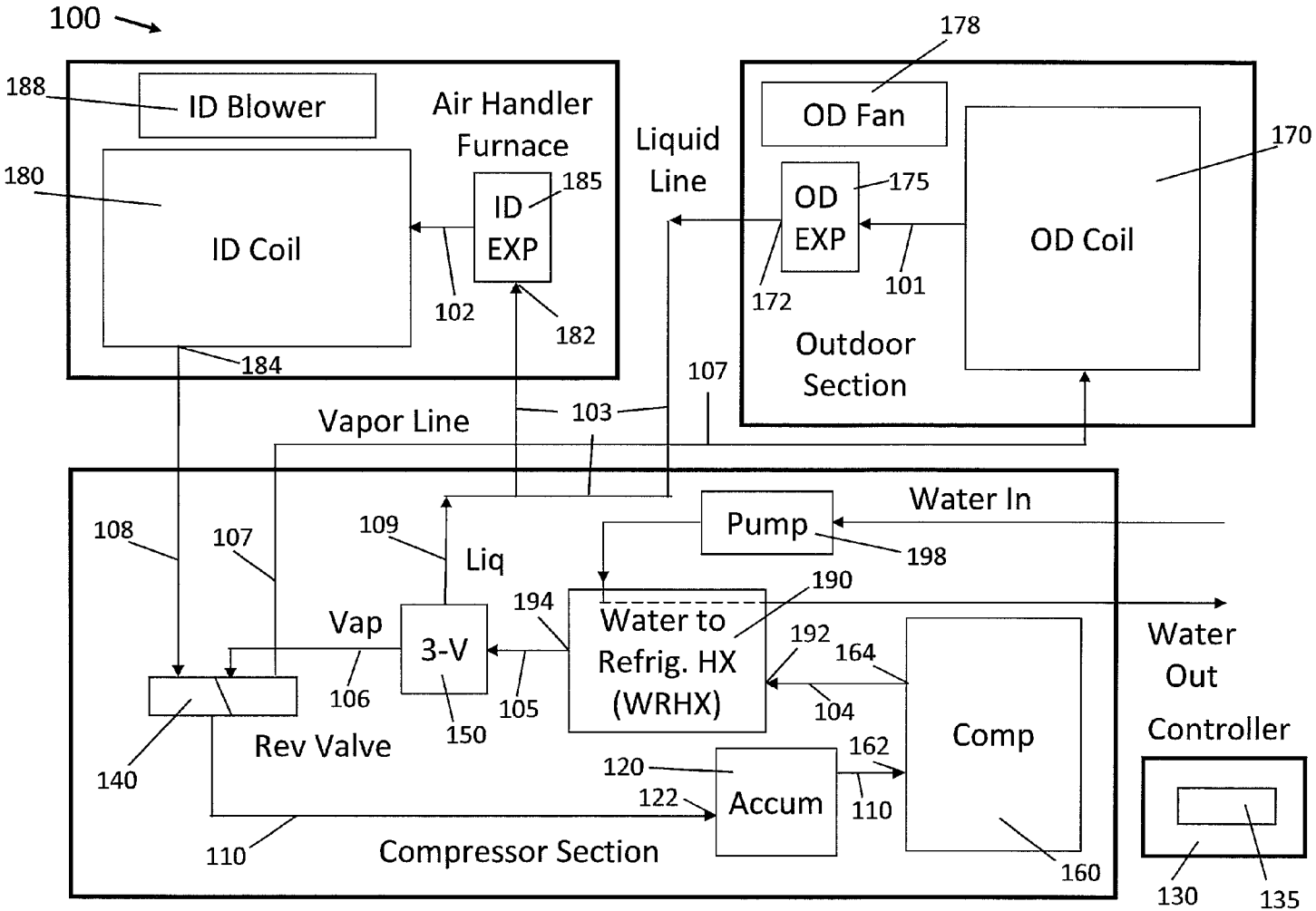
FIG. 1 is a block diagram illustrating an example of a heat pump operating in a cooling mode (i.e., cooling the space) that also heats water, the heat pump having an improved system to manage refrigerant charge.

These drawings illustrate, among other things, examples of certain aspects of particular embodiments of the invention. Other embodiments may differ. For example, in some embodiments, components or acts may be omitted, or acts may be performed in a different order. Various embodiments may include aspects shown in the drawings, described in the specification, shown or described in other documents that are incorporated by reference, known in the art, or a combination thereof, as examples.

SUMMARY OF PARTICULAR EMBODIMENTS OF THE INVENTION

This invention provides, among other things, heat pumps that heat and cool a space and that also heat water (e.g., domestic hot water), systems and methods of managing refrigerant charge in such heat pumps, and systems and methods for heating and cooling a space and for heating water. Particular embodiments deliver hot refrigerant gas to a particular heat exchanger of the heat pump that is not needed at that time for transferring heat, driving liquid refrigerant out of that particular heat exchanger, and then isolate the particular heat exchanger against additional refrigerant flowing into the particular heat exchanger. The heat pump is then operated while the particular heat exchanger is isolated. In some embodiments, the refrigerant charge is adjusted while the heat pump is being operated. Certain embodiments include a digital controller programmed to control the heat pump, include specific components, such as one or more expansion devices and one or more refrigerant management valves, that are used to isolate the particular heat exchanger. Further, in some embodiments, components are arranged in a particular manner, for example, with certain refrigerant conduits connecting different components.

Various embodiments provide, for example, as an object or benefit, that they partially or fully address or satisfy one or more of the needs, potential areas for benefit, or opportunities for improvement described herein, or known in the art, as examples. Certain embodiments provide, for instance, heat pumps that also heat water (e.g., domestic hot water) and refrigerant charge management methods and systems for heat pumps that also heat water that are less expensive, that utilize existing components to a greater extent, that provide for more modes of operation of the heat pump, that increase the efficiency of the heat pump, at least during particular modes of operation, that are less complex, that can be readily manufactured, that are easy to install, that are reliable, that have a long life, that are compact, that can withstand extreme environmental conditions, or a combination thereof, as examples.

Specific embodiments of the invention provide various methods of managing refrigerant charge in a heat pump that heats or cools a space and also heats water. Such a heat pump can include, for example, an outdoor heat exchanger that transfers heat between refrigerant and outdoor air or a heat source/sink, an indoor heat exchanger that transfers heat between the refrigerant and indoor air, a water heat exchanger that transfers heat from the refrigerant to water (e.g., domestic hot water), a compressor, and at least one expansion device. Further, the method can include, for example, at least certain acts. Such acts can include, for example, during conditions under which a particular heat exchanger of the heat pump is not needed for transferring heat, delivering refrigerant gas to the particular heat exchanger and driving liquid refrigerant out of the particular heat exchanger. Another such act is, for instance, while the refrigerant gas is in the particular heat exchanger, isolating the particular heat exchanger against additional refrigerant flowing into the particular heat exchanger. Still a further such act is, for example, while the particular heat exchanger is isolated against additional refrigerant flowing into the particular heat exchanger, operating the heat pump, including running the compressor.

In certain embodiments, for example (e.g., in a first mode of operation), the particular heat exchanger is the outdoor heat exchanger and the act of delivering refrigerant gas to the particular heat exchanger and driving liquid refrigerant out of the particular heat exchanger includes, for instance, during conditions under which the outdoor heat exchanger is not needed for transferring heat, delivering refrigerant gas to the outdoor heat exchanger and driving liquid refrigerant out of the outdoor heat exchanger. Moreover, in such embodiments, the act of isolating the particular heat exchanger against additional refrigerant flowing into the particular heat exchanger includes, for instance, while the refrigerant gas is in the outdoor heat exchanger, isolating the outdoor heat exchanger against additional refrigerant flowing into the outdoor heat exchanger. Further, in a number of such embodiments, the act of operating the heat pump includes, while the outdoor heat exchanger is isolated against additional refrigerant flowing into the outdoor heat exchanger (e.g., in addition to running the compressor), heating the water at the water heat exchanger and cooling the space using the indoor heat exchanger, for example.

On the other hand, in various embodiments (e.g., in a second mode of operation), the particular heat exchanger is the indoor heat exchanger, and the act of delivering refrigerant gas to the particular heat exchanger and driving liquid refrigerant out of the particular heat exchanger includes, for example, during conditions under which the indoor heat exchanger is not needed for transferring heat, delivering refrigerant gas to the indoor heat exchanger and driving liquid refrigerant out of the indoor heat exchanger. Moreover, in such embodiments, the act of isolating the particular heat exchanger against additional refrigerant flowing into the particular heat exchanger includes, for instance, while the refrigerant gas is in the indoor heat exchanger, isolating the indoor heat exchanger against additional refrigerant flowing into the indoor heat exchanger. Further, in a number of such embodiments, the act of operating the heat pump (e.g., including running the compressor), includes, while the indoor heat exchanger is isolated against additional refrigerant flowing into the indoor heat exchanger, heating the water at the water heat exchanger and extracting heat from the outdoor air or from the heat source/sink using the outdoor heat exchanger, for example. In different embodiments, the method can include the first mode of operation the second mode of operation, or both such modes of operation, as examples.

In a number of embodiments, the act of isolating the particular heat exchanger against additional refrigerant flowing into the particular heat exchanger includes closing a particular electronic expansion valve that is connected to the particular heat exchanger with a first refrigerant conduit. Moreover, in particular embodiments, the act of operating the heat pump includes keeping the particular electronic expansion valve closed for at least a majority of the act of operating the heat pump. Further, in various embodiments, the act of isolating the particular heat exchanger against additional refrigerant flowing into the particular heat exchanger includes actuating a refrigerant management valve located, for example, in a refrigerant conduit that connects the water heat exchanger to a reversing valve that is used to switch the heat pump between a heating mode, in which the heat pump heats the space, and a cooling mode, in which the heat pump cools the space. Moreover, in some embodiments, the act of isolating the particular heat exchanger against additional refrigerant flowing into the particular heat exchanger includes closing the particular electronic expansion valve and actuating the refrigerant management valve (e.g., as previously described).

Further, some embodiments include, for example, an act of adjusting the refrigerant charge. In certain embodiments, for instance, the act of adjusting the refrigerant charge takes place after the act of isolating the particular heat exchanger against additional refrigerant flowing into the particular heat exchanger, the act of adjusting the refrigerant charge takes place during the act of operating the heat pump, the act of adjusting the refrigerant charge includes using at least one of the particular electronic expansion valve or the refrigerant management valve to let refrigerant into the particular heat exchanger, or a combination thereof, for instance. Even further, in some embodiments, the act of adjusting the refrigerant charge includes monitoring refrigerant subcooling at a water heat exchanger outlet, for example, and letting refrigerant into the particular heat exchanger, for instance, if the subcooling at the water heat exchanger outlet exceeds a predetermined subcooling threshold. Moreover, in some embodiments, the act of driving liquid refrigerant out of the particular heat exchanger includes monitoring compressor discharge temperature, compressor discharge pressure, and duration of the act of driving liquid refrigerant out of the particular heat exchanger, as examples, and the act of driving liquid refrigerant out of the particular heat exchanger is terminated when the compressor discharge temperature exceeds a predetermined compressor discharge temperature threshold, the compressor discharge pressure exceeds a predetermined compressor discharge pressure threshold, or the duration of the act of driving liquid refrigerant out of the particular heat exchanger exceeds a predetermined duration of the act of driving liquid refrigerant out of the particular heat exchanger, for instance, whichever occurs first.

In some embodiments, during conditions under which a certain heat exchanger of the heat pump is used as an evaporator (i.e., the evaporator in such embodiments being different than the particular heat exchanger), the act of driving liquid refrigerant out of the particular heat exchanger includes monitoring refrigerant superheat, for example, between the evaporator and the compressor. In a number of embodiments, if the refrigerant superheat between the evaporator and the compressor is less than a predetermined bottom superheat threshold, then the method includes starting or accelerating an evaporator fan that blows air through the evaporator. Moreover, in a number of embodiments, if the refrigerant superheat between the evaporator and the compressor exceeds a predetermined top superheat threshold, then the method includes stopping or decelerating the evaporator fan that blows air through the evaporator.

Still other embodiments include various methods of heating and cooling a space, and also for heating water (e.g., domestic hot water). Such a method can include, for example, in any order, at least certain acts performed in different modes of operation. In various embodiments, these acts or modes of operation can include, for example, in a first mode of operation, heating the water while cooling the space without rejecting heat to the outdoor air or to the heat source/sink and without extracting heat from the outdoor air or from the heat source/sink, in a second mode of operation, heating the water while extracting heat from the outdoor air or from the heat source/sink, without heating the space and without cooling the space, and in a third mode of operation, heating the water while cooling the space and while rejecting heat to the outdoor air or to the heat source/sink. Moreover, a number of embodiments include, in a fourth mode of operation, heating the water while heating the space and while extracting heat from the outdoor air or from the heat source/sink, in a fifth mode of operation, cooling the space while rejecting heat to the outdoor air or to the heat source/sink, without heating the water, and in a sixth mode of operation, heating the space while extracting heat from the outdoor air or from the heat source/sink, without heating the water.

Further, in various embodiments, in at least one of the first mode or the second mode, for instance, the method includes managing the refrigerant charge, for example, in accordance with one of the methods described above. Even further, in a number of embodiments, during the method of heating and cooling the space, the rejecting of heat to the outdoor air or to the heat source/sink is accomplished using the outdoor heat exchanger, the extracting of heat from the outdoor air or from the heat source/sink is accomplished using the outdoor heat exchanger, and the heating of the water (e.g., domestic hot water) is accomplished using the water heat exchanger. Even further still, in various embodiments, the cooling of the space is accomplished using the indoor heat exchanger, and the heating of the space is accomplished using the indoor heat exchanger. In certain embodiments, the first mode of operation, the second mode of operation, or both, may be as previously described, for instance.

Still other embodiments of the invention include various heat pumps that heat or cool a space and that also heat water (e.g., domestic hot water). Such a heat pump can include, for example, an outdoor heat exchanger that transfers heat between refrigerant and outdoor air or a heat source/sink, an indoor heat exchanger that transfers heat between the refrigerant and indoor air, and a water heat exchanger that transfers heat from the refrigerant to the water. Further, a number of such embodiments include, as further examples, a compressor, at least one expansion device, and a digital controller, for instance. Moreover, in a number of embodiments, the digital controller can include, for example, programming instructions to manage refrigerant charge, for instance, in accordance with a method previously described.

Moreover, other specific embodiments of the invention include various heat pumps that heat or cool a space and that also heat water, that include various components, for example, in addition to components previously mentioned such as an outdoor heat exchanger that transfers heat between refrigerant and outdoor air or a heat source/sink, an indoor heat exchanger that transfers heat between the refrigerant and indoor air, a water heat exchanger that transfers heat from the refrigerant to water (e.g., domestic hot water), and a compressor. Such components can include, for instance, an outdoor expansion device, an indoor expansion device, a refrigerant management valve, a reversing valve, and various refrigerant conduits. These refrigerant conduits can include, in a number of embodiments, for example, a first refrigerant conduit connecting the outdoor heat exchanger to the outdoor expansion device, a second refrigerant conduit connecting the indoor heat exchanger to the indoor expansion device, and a third refrigerant conduit connecting the outdoor expansion device to the indoor expansion device. Moreover, various embodiments include, for instance, a fourth refrigerant conduit connecting a discharge port on the compressor to the water heat exchanger, a fifth refrigerant conduit connecting the water heat exchanger to the refrigerant management valve, and a sixth refrigerant conduit connecting the refrigerant management valve to the reversing valve. Further, a number of embodiments include a seventh refrigerant conduit connecting the reversing valve to the outdoor heat exchanger, an eighth refrigerant conduit connecting the reversing valve to the indoor heat exchanger, a ninth refrigerant conduit connecting the refrigerant management valve to the third refrigerant conduit, and a tenth refrigerant conduit connecting the reversing valve to an inlet port on the compressor, as examples.

Various embodiments can further include, for further example, a digital controller that can include, for instance, programming instructions to perform certain functions. In some embodiments, these functions can include, for instance, managing refrigerant charge by controlling the refrigerant management valve, managing refrigerant charge by controlling the outdoor expansion device and the indoor expansion device, or both. Further, in some embodiments, the digital controller can include, for example, programming instructions to manage refrigerant charge during conditions under which a particular heat exchanger is not needed for transferring heat, by delivering refrigerant gas to the particular heat exchanger and driving liquid refrigerant out of the particular heat exchanger. In various embodiments, the particular heat exchanger can be either the outdoor heat exchanger or the indoor heat exchanger, for example (e.g., depending on the mode of operation being performed).

Moreover, in some embodiments, the digital controller can include, programming instructions to isolate the particular heat exchanger against additional refrigerant flowing into the particular heat exchanger, for instance, while the refrigerant gas is in the particular heat exchanger. Further, in some embodiments, the digital controller can include, programming instructions to operate the heat pump, including running the compressor and heating the water at the water heat exchanger, for example, while the particular heat exchanger is isolated against additional refrigerant flowing into the particular heat exchanger. Even further, in particular embodiments, the digital controller includes programming instructions to perform at least one of the following acts: isolate the particular heat exchanger by controlling the refrigerant management valve, or isolate the particular heat exchanger by controlling the outdoor expansion device or the indoor expansion device. In addition, various other embodiments of the invention are also described herein, and other benefits of certain embodiments may be apparent to a person of ordinary skill in the art.

DETAILED DESCRIPTION OF EXAMPLES OF EMBODIMENTS

A number of embodiments of the subject matter described herein include heat pumps that heat and cool a space (e.g., within a building) and that also heat water (e.g., domestic hot water), systems and methods of managing refrigerant charge in such heat pumps, and systems and methods for heating and cooling a space and for heating water. Certain embodiments allow such heat pumps to be operated in one or more (e.g., two) modes not otherwise available without complex and expensive refrigerant management systems, significant loss in efficiency during certain modes or operation, or a combination thereof. Particular embodiments deliver hot refrigerant gas to a particular heat exchanger of the heat pump that is not needed at the time for transferring heat, drive liquid refrigerant out of that particular heat exchanger, and then isolate the particular heat exchanger against additional refrigerant flowing into the particular heat exchanger. The heat pump is then operated while the particular heat exchanger is isolated. In some embodiments, the refrigerant charge can be adjusted during operation.

Figure 2:
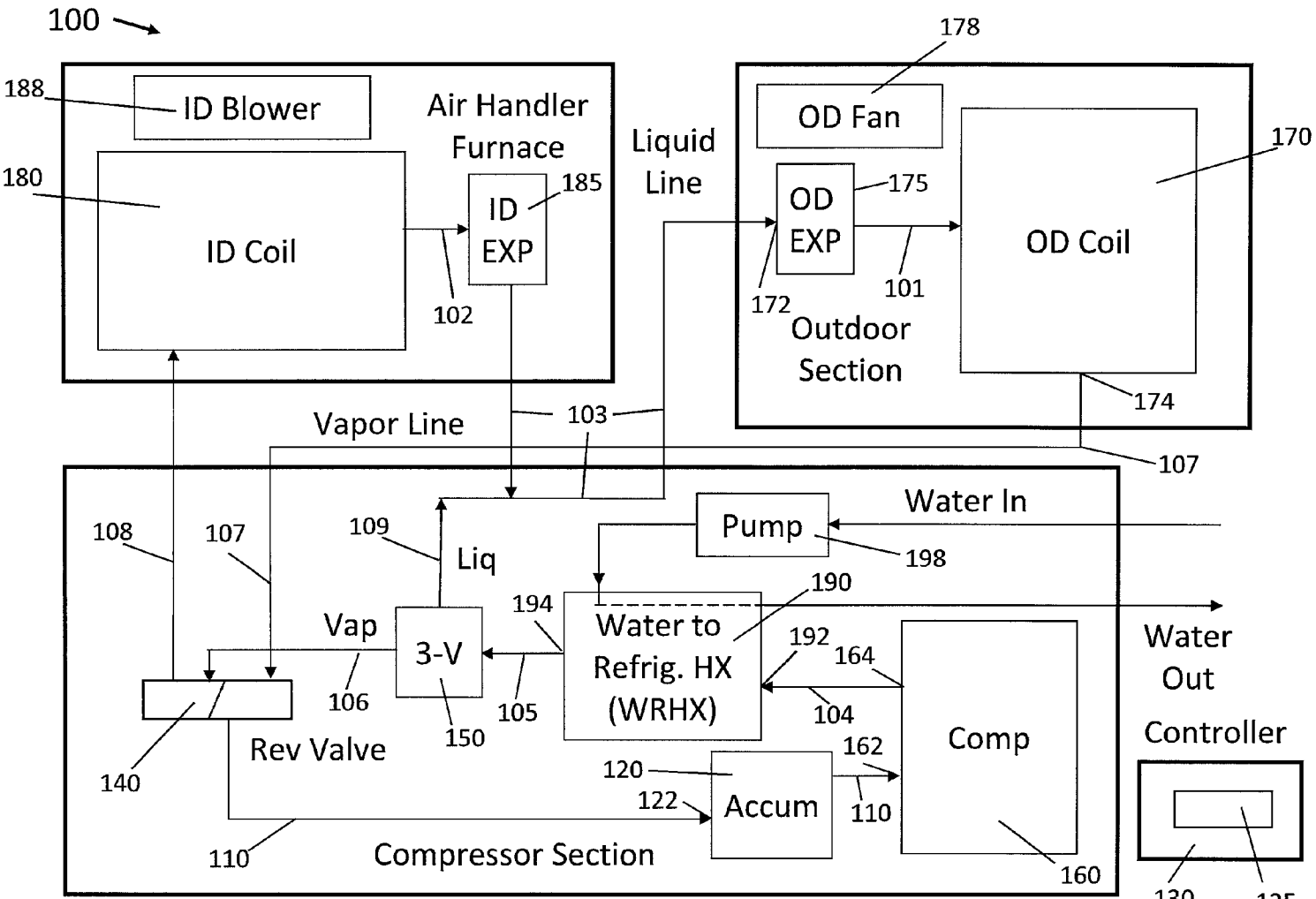
FIG. 2 is a block diagram illustrating the example of a heat pump shown in FIG. 1, except operating in a mode in which the space is neither heated nor cooled.

FIG. 1 illustrates an example of a heat pump, heat pump 100 operating in a cooling mode (i.e., cooling the space). In different modes of operation, heat pump 100 heats and cools a space (e.g., within a building) and also heats water (e.g., domestic hot water). Heat pump 100 has an improved system to manage refrigerant charge, which will be described in detail in the following paragraphs. FIG. 2 illustrates heat pump 100 operating in a mode that does not cool the space. Rather, in the mode of operation of FIG. 2, heat is extracted from the environment, in particular, from the outdoor air. Heat pump 100 is an example of a heat pump that heats or cools a space and that also heats water. Other embodiments may differ. Use of a heat pump (e.g., 100) to heat water can be more efficient and can reduce energy cost for heating water in comparison to use of a conventional electric resistance water heater in combination with a heat pump (used just to heat and cool the space) of the same efficiency.

In the embodiment illustrated, heat pump 100 includes outdoor heat exchanger 170 that transfers heat between refrigerant and outdoor air, indoor heat exchanger 180 that transfers heat between the refrigerant and indoor air, and desuperheater or water heat exchanger 190 that transfers heat from the refrigerant to water (e.g., domestic hot water). Heat pump 100, in this embodiment, also includes compressor 160, outdoor expansion device 175, indoor expansion device 185, refrigerant management valve 150, reversing valve 140, and various refrigerant conduits. These refrigerant conduits include, in this particular embodiment, for example, first refrigerant conduit 101 connecting outdoor heat exchanger 170 to outdoor expansion device 175, second refrigerant conduit 102 connecting indoor heat exchanger 180 to indoor expansion device 185, and third refrigerant conduit 103 connecting outdoor expansion device 175 to indoor expansion device 185. Moreover, this particular embodiment includes, for instance, fourth refrigerant conduit 104 connecting discharge port 164 on compressor 160 to water heat exchanger (e.g., domestic hot water heat exchanger) 190, fifth refrigerant conduit 105 connecting water heat exchanger 190 to refrigerant management valve 150, and sixth refrigerant conduit 106 connecting refrigerant management valve 150 to reversing valve 140. Further, this particular embodiment includes seventh refrigerant conduit 107 connecting reversing valve 140 to outdoor heat exchanger 170, eighth refrigerant conduit 108 connecting reversing valve 140 to indoor heat exchanger 180, ninth refrigerant conduit 109 connecting refrigerant management valve 150 to third refrigerant conduit 103, and tenth refrigerant conduit 110 connecting reversing valve 140 to inlet port 162 on compressor 160.

A "refrigerant conduit", as used herein, forms an enclosed passageway through which refrigerant flows or can flow and can be or include one or more sections of tubing or pipe, one or more passageways through one or more other components such as fittings, valve bodies, accumulators (e.g., 120), or a combination thereof, as examples. Further, refrigerant conduits described herein as "connecting" two components provide an enclosed passageway between the two components through which refrigerant flows or can flow, at least in one or more modes of operation. Unless explicitly described otherwise, however, specifically identified refrigerant conduits described herein, connecting different components, as used herein, do not include one or more other specifically identified refrigerant conduits described herein. Moreover, refrigerant conduits described herein may differ in shape or length from what is shown on the drawings, which are not drawn to scale.

The embodiment shown has two expansion devices 175 and 185. In this embodiment, in both modes of operation shown in FIGS. 1 and 2, refrigerant is delivered from refrigerant management valve 150 through refrigerant conduit 109 and is introduced to refrigerant conduit 103 between the two expansion devices 175 and 185. Other embodiments of heat pumps can function with just one expansion device, for example, performing the function of expansion device 175, performing the function of expansion device 185, or performing both such functions. For embodiments that have just one expansion device, however, where that one expansion device performs the functions of both expansion device 175 and expansion device 185, additional components may be necessary to route the refrigerant in different modes of operation. In many instances, use of two expansion devices (e.g., 175 and 185) can be less expensive, less complicated, or both, than providing additional components to route the refrigerant in different modes of operation with just one expansion device. Just one expansion device can be used, however, in embodiments of heat pumps that cool the space but do not heat the space (e.g., embodiments where a furnace, such as a gas furnace, is used to provide heat) or in embodiments that heat the space but do not cool the space, as examples.

Further, in different embodiments, heat pump 100 can be a packaged unit (e.g., for roof top installation) or a split system, with one component installed within the space (e.g., containing, among other things, indoor air coil 180 and indoor air blower or fan 188) while a second enclosed component is installed outdoors (e.g., containing, among other things, outdoor heat exchanger 170, outdoor fan 178, compressor 160, reversing valve 140, and accumulator 120) for example. Heat pump 100 can be a residential heat pump, for example, and can be used on a house, for instance. In other embodiments, however, heat pump 100 can be used to heat or cool (or both) another building such as a business, as another example. Some embodiments include the building.

As used herein, an "outdoor heat exchanger" is not necessarily located outdoors. In a number of embodiments, however, the "outdoor heat exchanger" exchanges heat with outdoor air. For instance, in the embodiment illustrated, outdoor heat exchanger 170 exchanges heat between the refrigerant and outdoor air moved by outdoor fan 178. But in other embodiments, the "outdoor heat exchanger" exchanges heat with a heat source/sink (e.g., other than the outdoor air), which may be located outdoors or indoors, in different embodiments. As used herein, a "heat source/sink" can act as a heat source, providing heat to the heat pump, can act as a heat sink, accepting heat rejected by the heat pump, or both. Examples of such a "heat source/sink" include the ground (e.g., a geothermal loop), soil, sand, rock, ground water, or surface water (e.g., a lake, a pond, a stream, or a river), as examples. In some embodiments, geothermal energy or heat can be used, or a solar collector or solar heat storage device can be used, for instance, as a heat source (e.g., for an outdoor heat exchanger). In still other embodiments, a compost pile or land fill can be used as a heat source (e.g., for an outdoor heat exchanger), as further examples. In some embodiments, an artificial heat source/sink, a thermal mass, or thermal reservoir can be used, which can include a phase change material, a tank of water, masonry, or concrete, as examples. Moreover, in some embodiments, a heat sink can be used that can be below outdoor ambient air temperature, such as a cooling tower, a fountain, a swimming pool, or a cooling pond, as examples. In some embodiments, more than one outdoor heat exchanger can be used, for example, one that exchanges heat with outdoor air and another that exchanges heat with a heat source/sink. Further, in some embodiments, more than one heat source/sink can be used, for instance, each with an outdoor heat exchanger. In some embodiments, for example, different heat source/sinks may be at different temperatures and one heat sink may be used to reject heat while a separate heat source may be used to obtain heat.

Water heat exchanger 190 can heat water circulated from a separate tank or water heater (e.g., electric resistance, gas, solar, geothermal, heat pump, or a combination thereof), for example, via water pump 198. In some embodiments, refrigerant delivered to water heat exchanger 190 from compressor 160 never exceeds the boiling temperature of the water, and pump 198 can be turned off when water heating is not needed or is not desired and boiling of the water in water heat exchanger 190 does not occur. In some embodiments, the separate water heater (i.e., separate from water heat exchanger 190) can include special connections, fittings, or attachment points that the water is taken from or delivered to (or both) for circulation through water heat exchanger 190. In other embodiments, however, a conventional water heater can be used and existing connections thereon can be used for circulating water through water heat exchanger 190. In other embodiments, water heat exchanger 190 includes a tank (e.g., with a refrigerant coil inside, for instance, in the bottom) and a separate tank or water heater can be omitted, at least in some applications. Such embodiments, however, may lack the flexibility of being able to turn off pump 198 when water heating is not desired. In some embodiments, a refrigerant bypass can be used for this purpose. Furthermore, in still other embodiments, a different fluid other than the water that is ultimately being heated (e.g., other than the domestic hot water) is circulated through "water" heat exchanger 190. This different fluid can also be circulated through a coil located in the separate tank or water heater or through a separate heat exchanger located thereby. In such embodiments, the different fluid can be antifreeze, for example, or a mixture of water and ethylene glycol.

In the embodiment illustrated, refrigerant management valve 150 is a three-way valve. In other embodiments, the refrigerant management valve can be a two-way valve or multiple two-way valves, as other examples. In one alternative, for instance, refrigerant management valve 150 is replaced with a Tee and a first two-way valve is installed in refrigerant conduit 106 while a second two-way valve is installed in refrigerant conduit 109. These two way valves are then wired so that one is open when the other is closed. In the embodiment shown, however, in the cooling mode of operation shown in FIG. 1, refrigerant management valve 150 allows outdoor heat exchanger 170 to be either connected in series with water heat exchanger 190 and indoor heat exchanger 180, or isolated (in combination with outdoor expansion device 175) from the remainder of heat pump 100 with water heat exchanger 190 and indoor heat exchanger 180 connected in series. Similarly, in the embodiment shown in the mode of operation shown in FIG. 2, refrigerant management valve 150 allows indoor heat exchanger 180 to be either connected in series with water heat exchanger 190 and outdoor heat exchanger 170, or isolated (in combination with indoor expansion device 185) from the remainder of heat pump 100 with water heat exchanger 190 and outdoor heat exchanger 170 connected in series.

Further, in the embodiment illustrated, outdoor expansion device 175 and indoor expansion device 185 are expansion valves, and in particular, are electronic expansion valves or EXV's. In this particular embodiment, indoor expansion device 185 operates in the cooling mode shown in FIG. 1 to control the refrigerant superheat at outlet 184 of indoor heat exchanger 180, for instance, at accumulator 120 (e.g., at inlet 122 of accumulator 120), or between outlet 184 and inlet 162 of compressor 160. Further, in this particular embodiment, outdoor expansion device 175 operates in the dedicated water heating mode shown in FIG. 2 to control the refrigerant superheat at outlet 174 of outdoor heat exchanger 170, for instance, at accumulator 120 (e.g., at inlet 122 of accumulator 120), or between outlet 174 and inlet 162 of compressor 160. In a number of embodiments, expansion devices 175 and 185 have an integral check valve therein, arranged in parallel with the orifice of the expansion device, to allow refrigerant to exit the corresponding heat exchanger without having to pass through the orifice of that expansion device.

In other embodiments, other types of expansion devices may be used other than electronic expansion valves. Further, in some embodiments, expansion devices can be used that are not electronic. Examples include thermal expansion valves, or TXVs. In a number of embodiments, a separate valve (e.g., automatic, electric, or electronic) is provided in series with the (e.g., non-electronic) expansion device, as another example. Further, in some embodiments, outdoor expansion device 175 is not necessarily located outdoors or in an outdoor enclosure, indoor expansion device 185 is not necessarily located indoors (e.g., in an air handler of a split system), or both. Indoor expansion device 185, however, reduces the pressure of the refrigerant when, or just before, the refrigerant enters indoor heat exchanger 180 (e.g., when indoor heat exchanger 180 is being used as an evaporator, for instance, as shown in FIG. 1). Similarly, outdoor expansion device 175 reduces the pressure of the refrigerant when, or just before, the refrigerant enters outdoor heat exchanger 170 (e.g., when outdoor heat exchanger 170 is being used as an evaporator, for instance, as shown in FIG. 2).

In this particular embodiment, heat pump 100 also includes digital controller 130 that includes, for instance, programming instructions 135 to perform certain acts or functions. In this embodiment, digital controller 130 includes a processor, memory, and various connections to control different components of heat pump 100, among other things. In a number of embodiments, digital controller includes a user interface, a display, a keypad, a keyboard, an input device, connections to various sensors, connections to external networks or to a master control system, or a combination thereof, as examples. Digital controller can be wired to various components of heat pump 100 when heat pump 100 is installed, for instance, with control wiring, power wiring, or both. Further, instructions 135 can include software running on digital controller 130, stored in the memory thereof, or both, for example. In some embodiments, for example, instructions 135 can include, for instance, instructions to manage refrigerant charge by controlling refrigerant management valve 150, instructions to manage refrigerant charge by controlling outdoor expansion device 175, instructions to manage refrigerant charge by controlling indoor expansion device 185, or a combination thereof.

Further, in some embodiments, digital controller 130 can include, for example, programming instructions (e.g., 135) to manage refrigerant charge during conditions under which a particular heat exchanger is not needed for transferring heat, by delivering refrigerant gas to the particular heat exchanger and driving liquid refrigerant out of the particular heat exchanger. In certain embodiments, for example, digital controller 130 may determine, or may act upon a determination made when controller 130 was programmed, that energy consumption can be reduced, operating cost can be reduced, or efficiency can be improved, by not using the particular heat exchanger for transferring heat under the circumstances existing at that time (e.g., relative demand for heating or cooling and for hot water). As used herein, this is an example of the particular heat exchanger not being "needed for transferring heat". As used herein, in this context, being deemed to not be beneficial is sufficient to be "not needed".

In various embodiments, the particular heat exchanger that is not needed for transferring heat can be either outdoor heat exchanger 170 or indoor heat exchanger 180, for example, depending on the mode of operation of heat pump 100. Moreover, in some embodiments, digital controller 130 can include programming instructions (e.g., 135) to isolate the particular heat exchanger against additional refrigerant flowing into the particular heat exchanger, for instance, while the refrigerant gas is in the particular heat exchanger. Further, in some embodiments, digital controller 130 can include programming instructions to operate heat pump 100, including running compressor 160, heating the water at water heat exchanger 190, or both, for example, while the particular heat exchanger is isolated against additional refrigerant flowing into the particular heat exchanger. Even further, in particular embodiments, digital controller 130 includes programming instructions (e.g., 135) to perform at least one of the following acts: isolate the particular heat exchanger by controlling refrigerant management valve 150, isolate the particular heat exchanger by controlling outdoor expansion device 175 or indoor expansion device 185, or both.

Certain embodiments include various methods, for example, of managing refrigerant charge in a heat pump (e.g., 100) that heats or cools a space and also heats water (e.g., domestic hot water). Such a heat pump can include, for example, an outdoor heat exchanger (e.g., 170) that transfers heat between refrigerant and outdoor air or a heat source/sink, as examples, an indoor heat exchanger (e.g., 180) that transfers heat between the refrigerant and indoor air, a water heat exchanger (e.g., 190) that transfers heat from the refrigerant to water, a compressor (e.g., 160), and at least one expansion device (e.g., 175, 185, or both). In this context, as used herein, the phrase "that transfers heat" means during at least one mode of operation (e.g., at least one of modes one to six or acts 401 to 406 described below) of the heat pump (e.g., 100), not necessarily while a particular act of a particular method (e.g., 300 described below) is being performed. Various embodiments of methods can include, for example, at least certain acts, which can be performed in the order indicated, one or more other orders, or any order, in some embodiments, except where a particular order is required, as examples.

Figure 3:
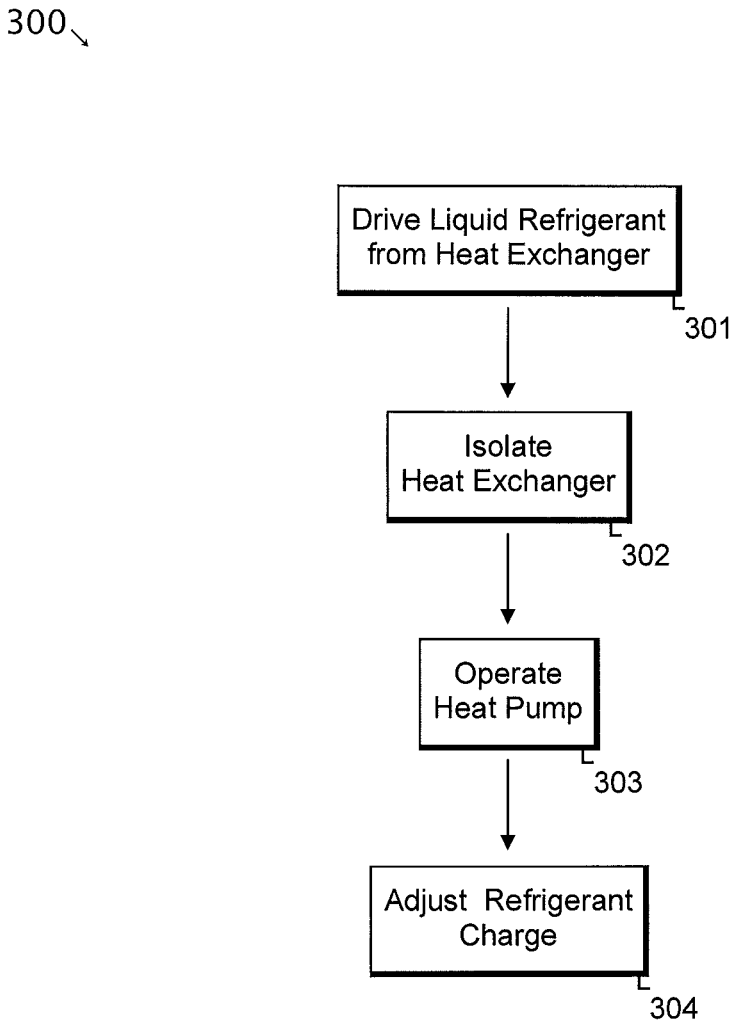
FIG. 3 is a flow chart illustrating an example of a method of managing refrigerant charge in a heat pump that heats and cools a space and that also heats water.

FIG. 3 illustrates a particular example of a method, method 300. In the example of method 300, the acts include, for example, during conditions under which a particular heat exchanger of the heat pump (e.g., 100) is not needed for transferring heat, act 301 of driving liquid refrigerant from the particular heat exchanger. In a number of embodiments, act 301 can include delivering refrigerant gas to the particular heat exchanger and driving liquid refrigerant out of the particular heat exchanger. In the embodiment shown in FIGS. 1 and 2, for example, compressor 160 can be run to deliver refrigerant gas to the particular heat exchanger in act 301. Refrigerant management valve 150 can be positioned to deliver the refrigerant through refrigerant conduits 105 and 106 to reversing valve 140, which can be positioned to deliver the refrigerant gas to the appropriate "particular" heat exchanger, which depends on the mode of operation.

In some embodiments, the fan associated with the particular heat exchanger (e.g., fan 178 or 188) can be off (e.g., remain off or be turned off) in act 301, or at least part of act 301, to let the particular heat exchanger get hot and liquid refrigerant therein to be pushed out or evaporate. In particular embodiments, for example, the particular heat exchanger fan is left off if the suction superheat is above a required low limit. In a number of embodiments, the temperature and pressure will continue to rise in act 301, at least while the particular heat exchanger fan is off. How quickly the temperature and pressure will rise (e.g., in act 301) can depend on the speed of the compressor (e.g., 160), in various embodiments. In a number of embodiments, compressor (e.g., 160) discharge temperature, discharge pressure, or both, can be monitored (e.g., at compressor discharge 164, within refrigerant conduit 104, or at water heat exchanger inlet 192, as examples). In some embodiments, pressure can be monitored further downstream, for example, at water heat exchanger outlet 194, or at refrigerant conduit 105, for instance. Such monitoring can be performed continuously or every 5 seconds, as examples, to make sure these parameters remain below the discharge temperature limit, pressure limit, or both, for instance, specified by the compressor manufacturer.

In this example, the refrigerant gas displaces and drives the liquid refrigerant out of the particular heat exchanger. In the embodiment shown, liquid refrigerant will be driven (e.g., in act 301) to the low pressure side (i.e., through the expansion device that being used to reduce pressure in the mode of operation taking place). The liquid refrigerant will first flood the evaporator, in this embodiment, and then may flood the accumulator (e.g., 120). The accumulator should be properly sized for this purpose. Liquid refrigerant flooding back to the compressor (e.g., 160) should typically be avoided. In a number of embodiments, refrigerant superheat is continuously monitored, for example, or sampled at regular intervals, for instance, every 5 seconds, for example, at outlet 174 or 184 of the heat exchanger that is acting as an evaporator, at accumulator 120 (e.g., at inlet 122 of accumulator 120), or between outlet 174 or 184 and inlet 162 of compressor 160. If the refrigerant superheat is above a certain temperature threshold, (e.g., 5 degrees F.), the evaporator fan (e.g., 178 or 188, depending on which heat exchanger 170 or 180 is acting as the evaporator) is decelerated or turned off, in particular embodiments, to allow more liquid to be stored in the evaporator. If the refrigerant superheat is below a particular temperature threshold, however, in some embodiments, the evaporator fan (e.g., 178 or 188, depending on which heat exchanger 170 or 180 is acting as the evaporator) is accelerated or turned on to prevent liquid refrigerant from flooding the accumulator.

Another act in method 300 is act 302, which includes, for instance, while the refrigerant gas (e.g., delivered in act 301) is in the particular heat exchanger, isolating the particular heat exchanger against additional refrigerant flowing into the particular heat exchanger. As used herein "isolating the particular heat exchanger against additional refrigerant flowing into the heat exchanger" means blocking all refrigerant conduits to the heat exchanger so that refrigerant cannot flow into the heat exchanger from the rest of the heat pump (e.g., 100), for instance, by closing or changing one or more valves. In this example, act 302 is performed after act 301. After the particular heat exchanger is isolated in act 302, the temperature of the particular heat exchanger and pressure therein will usually drop. Since the particular heat exchanger is isolated, however, refrigerant from other components of heat pump 100 (e.g., other than the particular heat exchanger) cannot flow into the particular heat exchanger, which prevents loss of refrigerant charge from heat pump 100 (excluding the particular heat exchanger).

In a number of embodiments, not all of the liquid refrigerant is driven out of the particular heat exchanger in act 301. Some liquid can remain, in particular embodiments. In certain embodiments, the amount of liquid refrigerant that remains in the particular heat exchanger (e.g., at the end of act 301 or when act 302 is performed) is controlled to provide the proper amount of refrigerant charge in heat pump 100 excluding the particular heat exchanger. Such control may be based on pressure, for example, within the system (i.e., heat pump 100). In some embodiments, other parameters may be measured as well for this determination (e.g., when to end act 301 or initiate act 302), such as temperature at one or more locations in the system.

In some embodiments, act 301 of driving liquid refrigerant out of the particular heat exchanger includes monitoring compressor discharge temperature, for example. Further, in some embodiments, act 301 of driving liquid refrigerant out of the particular heat exchanger includes monitoring compressor discharge pressure, for instance. Even further, in some embodiments, act 301 of driving liquid refrigerant out of the particular heat exchanger includes monitoring duration of the act of driving liquid refrigerant out of the particular heat exchanger. Some embodiments monitor just one such parameter, other embodiments monitor two such parameters, and still other embodiments monitor all three of these parameters. Certain embodiments monitor other parameters as well. In various embodiments, act 301 of driving liquid refrigerant out of the particular heat exchanger is terminated when the compressor discharge temperature exceeds a predetermined compressor discharge temperature threshold, the compressor discharge pressure exceeds a predetermined compressor discharge pressure threshold, or the duration of the act of driving liquid refrigerant out of the particular heat exchanger exceeds a predetermined duration, as examples.

In particular embodiments, act 301 of driving liquid refrigerant out of the particular heat exchanger includes monitoring compressor discharge temperature, compressor discharge pressure, and duration of the act of driving liquid refrigerant out of the particular heat exchanger, and act 301 of driving liquid refrigerant out of the particular heat exchanger is terminated when the compressor discharge temperature exceeds a predetermined compressor discharge temperature threshold, the compressor discharge pressure exceeds a predetermined compressor discharge pressure threshold, or the duration of the act of driving liquid refrigerant out of the particular heat exchanger exceeds a predetermined duration, whichever occurs first. In this context, as used herein, the term "exceeds" means reaches or exceeds. Further, as used herein, compressor discharge temperature, compressor discharge pressure, or both, can be measured, for example, (e.g., anywhere) between the compressor discharge and the next heat exchanger or expansion device that the refrigerant passes through. For example, in the embodiments of FIGS. 1 and 2, compressor discharge temperature, compressor discharge pressure, or both, can be measured, for example, at compressor discharge 164, refrigerant conduit 104, or at inlet 192 of water heat exchanger 190, as examples. In other embodiments, on the other hand, substantially all or all of the liquid refrigerant is driven out of the particular heat exchanger in act 301. In some embodiments, some refrigerant can be let back in to the heat exchanger to adjust the refrigerant charge (e.g., in act 304, described in more detail below).

In the embodiment illustrated, method 300 also includes, for example, while the particular heat exchanger is isolated (e.g., as initiated in act 302) against additional refrigerant flowing into the particular heat exchanger, act 303 of operating the heat pump (e.g., 100). Act 303 can include running compressor 160, for example. In a number of embodiments, act 303 can also include heating water at heat exchanger 190, as another example. In a number of embodiments, act 303 begins when act 302 takes place.

In various embodiments the "particular heat exchanger" can be the outdoor heat exchanger (e.g., 170), the indoor heat exchanger (e.g., 180), or the water heat exchanger (e.g., 190). In the embodiment illustrated in FIGS. 1 and 2, however the "particular heat exchanger" can only be outdoor heat exchanger 170 or indoor heat exchanger 180 because sufficient valves and refrigeration conduit are not included in this particular embodiment to isolate (e.g., in act 302) water heat exchanger 190. Other embodiments may include such valves and conduit, as another example, to isolate the water heat exchanger (e.g., in the sixth mode of operation or act 406, described below). In the particular embodiment illustrated in FIGS. 1 and 2, the "particular heat exchanger" can be the outdoor heat exchanger (e.g., 170) or the indoor heat exchanger (e.g., 180), depending on the mode of operation. In certain embodiments, in a first mode of operation, the "particular heat exchanger" is the outdoor heat exchanger (e.g., 170), in a second mode of operation or the "particular heat exchanger" is the indoor heat exchanger (e.g., 180). Further, in some embodiments, the heat pump operates in the first mode of operation but not the second mode of operation, in some embodiments, the heat pump operates in the second mode of operation but not the first mode of operation, and in some embodiments, the heat pump operates in the first mode of operation under certain conditions and in the second mode of operation under other conditions (e.g., as determined by controller 130).

In certain embodiments, for example (e.g., in the first mode of operation), the particular heat exchanger is the outdoor heat exchanger (e.g., 170), and the act of delivering refrigerant gas to the particular heat exchanger and driving liquid refrigerant out of the particular heat exchanger (e.g., act 301) includes, for instance, during conditions under which the outdoor heat exchanger (e.g., 170) is not needed for transferring heat (e.g., as determined by digital controller 130 of heat pump 100), delivering refrigerant gas to the outdoor heat exchanger and driving liquid refrigerant out of the outdoor heat exchanger. Moreover, in such embodiments, the act of isolating the particular heat exchanger against additional refrigerant flowing into the particular heat exchanger (e.g., act 302) includes, for instance, while the refrigerant gas is in the outdoor heat exchanger (e.g., 170), isolating the outdoor heat exchanger against additional refrigerant flowing into the outdoor heat exchanger (e.g., by actuating refrigerant management valve 150, by closing expansion device 175, or both). Further, in a number of such embodiments, the act of operating the heat pump (e.g., 303), including running the compressor (e.g., 160) includes, while the outdoor heat exchanger is isolated (e.g., in act 302) against additional refrigerant flowing into the outdoor heat exchanger, operating the heat pump (e.g., 100), including running the compressor (e.g., 160), heating the water at the water heat exchanger (e.g., 190), and cooling the space using the indoor heat exchanger (e.g., 180), for example.

In various embodiments (e.g., in a second mode of operation), the particular heat exchanger is the indoor heat exchanger (e.g., 180), and the act of delivering refrigerant gas to the particular heat exchanger and driving liquid refrigerant out of the particular heat exchanger (e.g., act 301) includes, for example, during conditions under which the indoor heat exchanger is not needed for transferring heat (e.g., as determined by controller 130), delivering refrigerant gas to the indoor heat exchanger (e.g., 180) and driving liquid refrigerant out of the indoor heat exchanger. Moreover, in a number of embodiments, the act of isolating the particular heat exchanger against additional refrigerant flowing into the particular heat exchanger includes, for instance, while the refrigerant gas is in the indoor heat exchanger, isolating the indoor heat exchanger (e.g., 180) against additional refrigerant flowing into the indoor heat exchanger (e.g., act 302, for instance, by actuating refrigerant management valve 150, by closing expansion device 185, or both). Further, in a number of such embodiments, the act of operating the heat pump (e.g., 303), including running the compressor (e.g., 160) includes, while the indoor heat exchanger is isolated against additional refrigerant flowing into the indoor heat exchanger, operating the heat pump, including running the compressor (e.g., 160), heating the water at the water heat exchanger (e.g., 190), and extracting heat from outdoor air or from a heat source/sink, as examples, using the outdoor heat exchanger (e.g., 170), for instance.

In different embodiments, the method can include the first mode of operation, the second mode of operation, or both, or can include at least one of the first mode of operation or the second mode of operation, as another example. In some embodiments, the method includes just the first mode of operation. In other embodiments, the method includes just the second mode of operation. And in still other embodiments, the method includes both the first mode of operation and the second mode of operation, as another example.

In a number of embodiments, act 302 of isolating the particular heat exchanger against additional refrigerant flowing into the particular heat exchanger includes closing a particular expansion device or electronic expansion valve that is connected to the particular heat exchanger, for instance, with a first refrigerant conduit. Moreover, in particular embodiments, act 303 of operating the heat pump includes keeping the particular expansion device or electronic expansion valve closed for at least a majority of act 303 of operating the heat pump (e.g., 100). In different embodiments, the "particular electronic expansion device" can be outdoor expansion device 175 or indoor expansion device 185, as examples. Moreover, in certain embodiments, in a first mode of operation, the "particular electronic expansion device" is outdoor expansion device 175, and in a second mode of operation, the "particular electronic expansion device" is indoor expansion device 185, as another example.

Further, in some embodiments or modes of operation in which the "particular electronic expansion device" is outdoor expansion device 175, the "first refrigerant conduit" is first refrigerant conduit 101 connecting outdoor heat exchanger 170 to outdoor expansion device 175. Further still, in some embodiments or modes of operation in which the "particular electronic expansion device" is indoor expansion device 185, the "first refrigerant conduit" (i.e., in the context of this example) is second refrigerant conduit 102 connecting indoor heat exchanger 180 to outdoor expansion device 185. Even further still, in some embodiments, even in the context of this example, the particular expansion device or electronic expansion valve can be opened for a short time (e.g., in act 304) to let refrigerant into the particular heat exchanger to adjust the refrigerant charge in the system (e.g., in heat pump 100 excluding the particular heat exchanger). In a number of embodiments, the particular expansion device or electronic expansion valve can be opened (e.g., in act 304) for a minority or small fraction (e.g., less than 10, 5, 3, 2, or 1 percent) of the duration of act 303 of operating the heat pump, as examples. Act 304 can be performed, in particular embodiments, to let refrigerant into the particular heat exchanger to adjust the refrigerant charge in the system (e.g., in heat pump 100 excluding the particular heat exchanger and certain refrigerant conduits connected to the particular heat exchanger). In a number of embodiments, act 304 may be controlled (e.g., by controller 130) based on pressure, for example, within the system (i.e., within heat pump 100). In some embodiments, other parameters may be measured as well for this determination (e.g., to control act 304), such as temperature at one or more locations in the system. In other embodiments, on the other hand, refrigerant charge may be controlled in another way.

In certain embodiments, act 302 of isolating the particular heat exchanger against additional refrigerant flowing into the particular heat exchanger includes actuating a refrigerant management valve (e.g., 150). In the particular embodiment shown, refrigerant management valve 150 is located, for example, in a refrigerant conduit (e.g., 105 and 106, as shown) that connects water heat exchanger 190 to reversing valve 140 that is used to switch heat pump 100 between a heating mode, in which the heat pump heats the space, and a cooling mode, in which the heat pump cools the space. In the embodiment shown, in either the first mode (FIG. 1) or the second mode (FIG. 2), act 302 is accomplished by switching refrigerant management valve 150 so that refrigerant entering refrigerant management valve 150 from refrigerant conduit 105 is directed into refrigerant conduit 109 rather than into refrigerant conduit 106. When act 302 takes place, or prior to act 302 taking place, the particular expansion device (e.g., 175 or 185, depending on the mode of operation) is closed (e.g., under the direction of controller 130). The particular fan (e.g., 178 or 188 depending on the mode) can be turned off or remain off, during act 303, and water pump 198 is turned on, in the embodiment illustrated, In embodiments and modes of operation in which the water heat exchanger is the particular heat exchanger, however, the water pump can be off during act 303. Compressor 160 is set to the desired speed (in embodiments where compressor 160 is a variable speed compressor or has a variable speed drive) in act 303 (e.g., under the control of controller 130), and the evaporator fan (e.g., whichever fan 178 or 188 is not the "particular" fan) is turned on or set to the desired speed (e.g., by controller 130) in the embodiment illustrated.

Moreover, in the particular embodiment illustrated, act 302 of isolating the particular heat exchanger against additional refrigerant flowing into the particular heat exchanger includes closing the particular expansion device or electronic expansion valve (e.g., 175 or 185) and actuating the refrigerant management valve (e.g., 150). In the particular embodiment illustrated, both the appropriate expansion device and the refrigerant management valve are actuated to isolate the heat exchanger. Which expansion device or valve is actuated depends on which heat exchanger (e.g., 170 or 180) is being isolated (i.e., which heat exchanger is the "particular heat exchanger") in the particular mode of operation sought (e.g., the first mode of operation or the second mode of operation described herein).

Still referring to FIG. 3, as mentioned, some embodiments include, for example, act 304 of adjusting the refrigerant charge. In certain embodiments, as illustrated, act 304 of adjusting the refrigerant charge takes place after act 302 of isolating the particular heat exchanger against additional refrigerant flowing into the particular heat exchanger. In a number of embodiments, however, act 304 of adjusting the refrigerant charge takes place during act 303 of operating the heat pump (e.g., 100). In some embodiments, act 304 of adjusting the refrigerant charge includes using the particular electronic expansion valve (e.g., expansion device 175 or 185) to let refrigerant into the particular heat exchanger. In other embodiments, on the other hand, act 304 of adjusting the refrigerant charge includes using the refrigerant management valve (e.g., 150) to let refrigerant into the particular heat exchanger. Moreover, in particular embodiments, act 304 of adjusting the refrigerant charge includes using both one of the particular electronic expansion valves (e.g., expansion device 175 or 185) and the refrigerant management valve (e.g., 150) to let refrigerant into the particular heat exchanger. In many embodiments, however, use of one valve is sufficient for act 304. In various embodiments, act 304 of adjusting the refrigerant charge includes using at least one of the particular electronic expansion valve (e.g., expansion device 175 or 185) or the refrigerant management valve (e.g., 150) to let refrigerant into the particular heat exchanger. In some embodiments, in act 304, refrigerant management valve 150 is opened and held open for 0.1, 0.25, 0.5, 1, 2, 3, 4, or 5 seconds, as examples, or within a range from 0.1 to 10 seconds, 0.25 to 5 seconds, 0.5 to 4 seconds, or 1 to 3 seconds, as examples, before being closed. Further, in some embodiments, in act 304, electronic expansion valve or expansion device 175 or 185 is opened and held open for 1, 2, 3, 4, 5, 6, 7, 8, 9, 10, 12, 15, 20, or 30 seconds, as examples, or within a range from 1 to 30 seconds, 2 to 20 seconds, 4 to 15 seconds, or 8 to 12 seconds, as examples, before being closed. In certain embodiments, in act 304, electronic expansion valve or expansion device 175 or 185 is opened to the default condition or the Y-signal is applied, for example.

In certain embodiments, act 304 of adjusting the refrigerant charge includes monitoring refrigerant subcooling at the water heat exchanger outlet (e.g., 194), for example, and letting refrigerant into the particular heat exchanger, for instance, if the subcooling at the water heat exchanger outlet (e.g., 194) exceeds a predetermined subcooling threshold. In this context, the "water heat exchanger outlet" means anywhere from the water heat exchanger (e.g., 190) to the next heat exchanger or expansion device that the refrigerant passes through after leaving the water heat exchanger (e.g., indoor expansion device 185 in the mode shown in FIG. 1 or outdoor expansion device 175 in the mode shown in FIG. 2, whichever of these two expansion valves is not associated with the heat exchanger that is acting as the particular heat exchanger). Thus, in this context of monitoring refrigerant subcooling for act 304, the "water heat exchanger outlet" includes refrigerant conduits 105, 109, and part of 103 from 109 to indoor expansion device 185, in the mode shown in FIG. 1, as well as water heat exchanger 190, refrigerant management valve 150, and inlet 182 of indoor expansion device 185. (In this example, inlet 182 of indoor expansion device 185 is an inlet in the mode shown in FIG. 1 but is an outlet in the mode shown in FIG. 2.) Similarly, in this context, the "water heat exchanger outlet" includes refrigerant conduits 105, 109, and part of 103 from 109 to outdoor expansion device 175, in the mode shown in FIG. 2, as well as water heat exchanger 190, refrigerant management valve 150, and inlet 172 of outdoor expansion device 175. (In this example, inlet 172 of outdoor expansion device 175 is an inlet in the mode shown in FIG. 2 but is an outlet in the mode shown in FIG. 1.)

In some embodiments, the predetermined subcooling threshold is 15 degrees F., for example. For instance, in some embodiments, if the subcooling is above 15 degrees F., the refrigerant charge is adjusted (e.g., in act 304) and if the subcooling is below 15 degrees F., the refrigerant charge is not adjusted (act 304 is not performed). In other embodiments, on the other hand, the predetermined subcooling threshold is between 5 and 30 degrees F., between 10 and 20 degrees F., between 12 and 18 degrees F., or between 13 and 17 degrees F., as examples. In particular embodiments, once act 304 is performed or the refrigerant charge is adjusted, a minimum stabilization time is allowed to pass before act 304 is repeated or the refrigerant charge is adjusted again. This minimum stabilization time can be 60 seconds, for example. In other embodiments, the stabilization time can be between 20 and 180 seconds, between 30 and 120 seconds, or between 45 and 90 seconds, as examples. In a number of embodiments, the same criteria is applied whether the indoor heat exchanger (e.g., 180) or the outdoor heat exchanger (e.g., 170) is acting as the isolated or "particular" heat exchanger.

In some embodiments, act 304 is not initiated until at least a certain amount of time after act 303 is started (e.g., after act 302). This amount of time may be 1, 2, 3, 4, 5, 7, or 10 minutes, as examples, or within a range from 1 to 10 minutes, from 2 to 7 minutes, from 2 to 5 minutes, or from 3 to 4 minutes, as examples. In a number of embodiments, in act 304, if the subcooling is too high, the particular expansion device (e.g., electronic expansion valve, for instance, 175 or 185, depending on the mode of operation) is opened or the refrigerant management valve 150 is opened (e.g., briefly) to allow some refrigerant to flow back into the particular heat exchanger. This event can be rather short to prevent too much refrigerant from flowing back into the particular heat exchanger, and can last less than a minute, 10, 5, 3, 2, or 1 seconds, less than such a number of seconds, or a fraction of a second, as examples, after which the particular expansion device or the refrigerant management valve is closed. Generally, use of an electronic expansion valve for act 304 provides for a gradual and controlled change in refrigerant charge and resulting subcooling. In other embodiments, however, a refrigerant management valve (e.g., 150) can be used for act 304, for example, in embodiments that do not have an electronic expansion valve (e.g., in embodiments that have a TXV). In some embodiments, after a period of time (e.g., 1, 2, 3, 4, 5, 7, or 10 minutes, as examples) act 304 is repeated if the subcooling is still too high.

In some embodiments, during conditions under which a certain heat exchanger of the heat pump (e.g., 100) is used as an evaporator, act 301 of driving liquid refrigerant out of the particular heat exchanger includes monitoring refrigerant superheat, for example, between the evaporator and the compressor (e.g., 160). In this example, the "evaporator" is one of the heat exchangers of heat pump 100 other than the "particular heat exchanger". In some embodiments and modes of operation, for instance, as shown in FIG. 1, the evaporator is indoor heat exchanger 180 and the particular heat exchanger is outdoor heat exchanger 170. Further, in some embodiments and modes of operation, for example, as shown in FIG. 2, the evaporator is outdoor heat exchanger 170 and the particular heat exchanger is indoor heat exchanger 180. Moreover, in this context, "between the evaporator and the compressor" includes, in the example of FIG. 1, indoor heat exchanger outlet 184, refrigerant conduit 108, reversing valve 140, refrigerant conduit 110, accumulator 120, and compressor inlet 162. Furthermore, in this context, "between the evaporator and the compressor" includes, in the example of FIG. 2, outdoor heat exchanger outlet 174, refrigerant conduit 107, reversing valve 140, refrigerant conduit 110, accumulator 120, and compressor inlet 162.

In a number of embodiments, if the refrigerant superheat between the evaporator and the compressor (e.g., 160) is less than a predetermined bottom superheat threshold, then the method (e.g., 300) includes (e.g., within act 301) starting or accelerating an evaporator fan that blows air through the evaporator. In the example of FIG. 1, for instance, indoor air fan 188 is the evaporator fan. In the example of FIG. 2, on the other hand, outdoor air fan 178 is the evaporator fan. In some embodiments, the evaporator and evaporator fans (as well as the particular heat exchanger) are different components in different modes of operation. Even further, in a number of embodiments, if the refrigerant superheat between the evaporator and the compressor (e.g., 160) exceeds a predetermined top superheat threshold, then the method (e.g., 300) includes (e.g., within act 301) stopping or decelerating the evaporator fan that blows air through the evaporator.

In some embodiments and modes of operation, the evaporator fan is a single speed fan (i.e., a fan having a single-speed motor that is either on or off, without a variable-speed drive). In a number of such embodiments, if the refrigerant superheat between the evaporator and the compressor is less than the predetermined bottom superheat threshold, then the evaporator fan that blows air through the evaporator is started (e.g., from a stop). Further, in such embodiments and modes of operation, if the refrigerant superheat between the evaporator and the compressor exceeds the predetermined top superheat threshold, then the evaporator fan that blows air through the evaporator is stopped (e.g., is turned off). Further, in some embodiments and modes of operation, the evaporator fan is a multiple speed or variable speed fan (i.e., a fan having a multiple-speed motor or a variable speed drive). In a number of such embodiments, if the refrigerant superheat between the evaporator and the compressor is less than the predetermined bottom superheat threshold, then the evaporator fan that blows air through the evaporator is accelerated (e.g., increased in speed, either from a stop or from a lower speed). Further, in such embodiments and modes of operation, if the refrigerant superheat between the evaporator and the compressor exceeds the predetermined top superheat threshold, then the evaporator fan that blows air through the evaporator is decelerated (e.g., reduced in speed or turned off).

Figure 4:
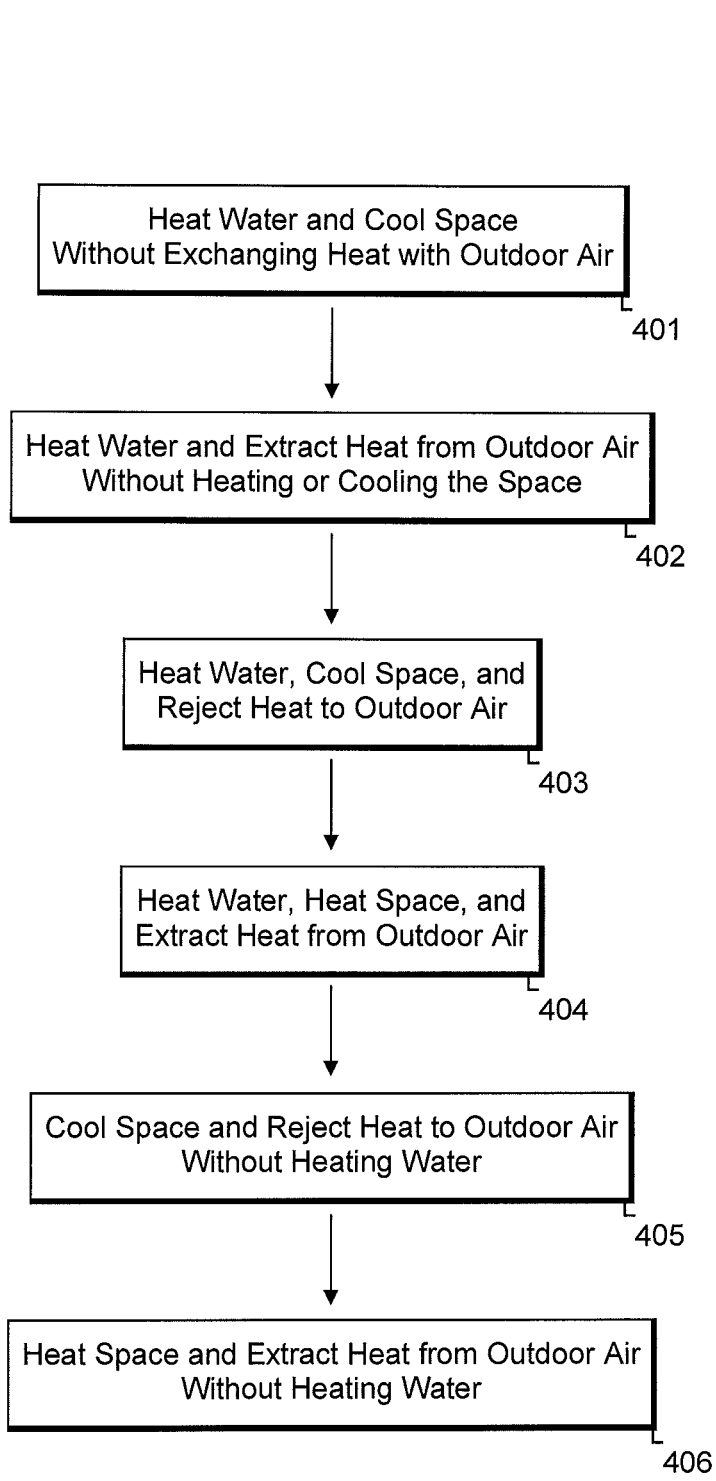
FIG. 4 is a flow chart illustrating an example of a method of heating and cooling a space and for also heating water, illustrating multiple modes of operation, some of which can involve particular acts to manage the refrigerant charge.

Certain embodiments include various methods of heating and cooling a space and also for heating water, for example, domestic hot water. Such a method can include, for example, in any order, at least certain acts, which can be performed in different modes of operation. FIG. 4 illustrates an example of such a method, method 400, which includes various acts or modes of operation. In certain acts of FIG. 4, outdoor air is identified. In particular, embodiments, however, a heat source/sink, other than outdoor air, can be used instead of outdoor air. In the embodiment illustrated, method 400 includes, in a first mode of operation, act 401 of heating water, for instance, domestic hot water, while cooling the space without rejecting heat to outdoor air or to a heat source/sink and without extracting heat from the outdoor air or from the heat source/sink, as examples. Heat pump 100 is performing act 401 in FIG. 1, for example. In this first mode of operation (e.g., act 401 in FIG. 4), in the embodiment shown in FIG. 1, during act 303 of method 300 shown in FIG. 3, indoor heat exchanger 180 acts as the evaporator and water heat exchanger 190 acts as the condenser. Thus, heat pump 100 moves thermal energy from the space to the water (e.g., domestic hot water), cooling the space while heating the water.

Further, method 400 also includes, in the embodiment shown, in a second mode of operation, act 402, of heating water (e.g., domestic hot water) while extracting heat from the outdoor air (or from a heat source/sink), without heating the space and without cooling the space. Heat pump 100 is performing act 402 in FIG. 2, for example. In this second mode of operation (e.g., act 402 in FIG. 4), in the embodiment shown in FIG. 2, during act 303 of method 300 shown in FIG. 3, outdoor heat exchanger 170 acts as the evaporator and water heat exchanger 190 acts as the condenser. Thus, heat pump 100 moves thermal energy from the outdoor air or from the heat source/sink, as examples, to the water (e.g., domestic hot water), cooling the environment, for instance, while heating the water.

The first mode of operation, act 401, is a combined cooling (of the space) and water heating mode, and the second mode of operation, act 402, is a dedicated water heating mode. Both the first and the second modes of operation (e.g., acts 401 and 402) are water heating modes in which all of the heat moved by heat pump 100 in these modes (except for minor losses) is delivered to the water (e.g., via water heat exchanger 190). These modes of operation provide for higher capacity water heating than other possible modes of operation, since in these modes, the water heat exchanger (e.g., 190) can fully condense the refrigerant to a subcooled liquid rather than just desuperheating the refrigerant. This can be a significant advantage, particularly under conditions when demand for heating of the space is not present and demand for cooling of the space is not especially high. Since these two modes of operation do not use one of either the indoor heat exchanger (e.g., 180) or the outdoor heat exchanger (e.g., 170), changing to either of these modes of operation (i.e., the first mode or the second mode of operation) will result in the accumulation of liquid refrigerant in the unused heat exchanger and insufficient refrigerant charge in the heat pump (e.g., 100), unless refrigerant management action is taken such as method 300 shown in FIG. 3 and described herein, or other more elaborate and more costly solutions. Thus, use of method 300, for example, at least in the first and second modes of operation, provides for greater system flexibility under different operating conditions.

Further still, method 400 includes, in the embodiment illustrated, in a third mode of operation, act 403 of heating water (e.g., domestic hot water) while cooling the space and while rejecting heat to the outdoor air or to the heat source/sink, as examples. In this third mode of operation (e.g., act 403 in FIG. 4), indoor heat exchanger 180 acts as the evaporator and water heat exchanger 190 acts as a desuperheater. Outdoor heat exchanger 170 acts as the condenser. Thus, heat pump 100 moves thermal energy from the space to the water (e.g., domestic hot water) and to the outdoor air, in this embodiment, cooling the space while heating the water and heating the environment. The third mode of operation, act 403, is appropriate for circumstances under which demand for cooling of the space is high or demand for heating of the water is insufficiently high to use all of the heat removed from the space to meet the cooling demand.

Moreover, method 400 includes, in this embodiment, in a fourth mode of operation, act 404 of heating the water while heating the space and while extracting heat from the outdoor air (or from a heat source/sink, as another example). In this fourth mode of operation (e.g., act 404 in FIG. 4), indoor heat exchanger 180 acts as the condenser and water heat exchanger 190 acts as a desuperheater. Outdoor heat exchanger 170 acts as the evaporator. Thus, heat pump 100 moves thermal energy from the outdoor air, for instance, to the space and to the water (e.g., domestic hot water) and heating the space while heating the water and cooling the environment. The fourth mode of operation, act 404, is appropriate for circumstances under which demand exists for both heating of the space and for heating of the water, but neither demand is so high as to overshadow the other.

Even further still, method 400 includes, in the embodiment shown, in a fifth mode of operation, act 405 of cooling the space while rejecting heat to the outdoor air (or to a heat source/sink, as another example), without heating water (e.g., domestic hot water). In this fifth mode of operation, water pump 198 is turned off. Further, in this fifth mode of operation (e.g., act 405 in FIG. 4), indoor heat exchanger 180 acts as the evaporator and outdoor heat exchanger 170 acts as the condenser. Thus, heat pump 100 moves thermal energy from the space to the outdoor air, cooling the space while heating the environment. In this mode of operation, in the embodiment illustrated in FIG. 1. for example, water heat exchanger 190 acts simply as a refrigerant conduit. In other embodiments, a refrigerant bypass can route the refrigerant around the water heat exchanger (e.g., 190), as another example. Such a refrigerant bypass can include at least one bypass valve (e.g., a three-way valve or a two-way valve, suitable refrigerant conduit, and fittings, such as Tee's, for instance. In embodiments where the water heat exchanger (e.g., 190), can act as the "particular heat exchanger", there may be two bypass valves (e.g., two three-way valves), or the bypass valve may be a four-way valve, as other examples. In some embodiments, such a refrigerant bypass can reduce refrigerant pressure drop in comparison with routing the refrigerant through the water heat exchanger (e.g., 190) in act 405. The fifth mode of operation, act 405, is appropriate for circumstances under which demand exists for cooling of the space but there is no demand for heating of the water (e.g., the water is already at a maximum temperature).

Still further, in a sixth mode of operation, act 406 of heating the space while extracting heat from the outdoor air (or from a heat source/sink, as another example), also without heating water (e.g., domestic hot water). In this sixth mode of operation, water pump 198 is turned off. Further, in this sixth mode of operation (e.g., act 406 in FIG. 4), indoor heat exchanger 180 acts as the condenser and outdoor heat exchanger 170 acts as the evaporator. Thus, heat pump 100 moves thermal energy from the outdoor air, for instance, to the space, cooling the environment while heating the space. In this mode of operation, in the embodiment illustrated in FIG. 2. for example, water heat exchanger 190 acts simply as a refrigerant conduit. In other embodiments, a refrigerant bypass can route the refrigerant around the water heat exchanger (e.g., 190), as another example. Such a refrigerant bypass can include at least one bypass valve (e.g., a three-way valve or a two-way valve, suitable refrigerant conduit, and fittings, such as Tee's, for instance. In embodiments where the water heat exchanger (e.g., 190), can act as the "particular heat exchanger", there may be two bypass valves (e.g., two three-way valves), or the bypass valve may be a four-way valve, as other examples. In some embodiments, such a refrigerant bypass can reduce refrigerant pressure drop in comparison with routing the refrigerant through the water heat exchanger (e.g., 190) in act 406. The sixth mode of operation, act 406, is appropriate for circumstances under which demand for heating of the space is high and demand for heating of the water is insufficiently low that it is desirable to use all of the heat removed from the environment to heat the space rather than heating the water. This mode is also appropriate for circumstances under which demand exists for heating of the space (even if not high) and there is no demand for heating of the water (e.g., the water is already at a maximum temperature).

In a number of embodiments, the HVAC unit controller (e.g., 130) can select the mode of operation (e.g., from FIG. 4), for instance, by controlling reversing valve 140, by controlling refrigerant management valve 150, by controlling water pump 198, by controlling expansion devices 175 and 185, by controlling fans 178 and 188, or a combination thereof, as examples. In various embodiments, these different modes of operation can be performed in any order depending, for example, on demand for heating or cooling of the space and for heating of the water. Further, a number of embodiments include or perform fewer than all of the modes of operation or acts of method 400 shown in FIG. 4 and described herein. For example, some embodiments omit or do not require act 405, act 406, or both. In a number of embodiments, method 300, shown in FIG. 3, for instance, in one of the embodiments described herein, can be performed in act 401, act 402, or both, for example. Moreover, in certain embodiments, method 300, shown in FIG. 3, for instance, in one of the embodiments described herein, can be performed in act 405, act 406, or both, for another example (e.g., in embodiments in which the water heat exchanger can be isolated or can be the "particular heat exchanger"). As described, however, in embodiments where method 300 is performed in act 405, act 406, or both, additional valves, refrigerant conduit, or both, may be required over what is shown in FIGS. 1 and 2 to isolate and bypass water heat exchanger 190. In other embodiments, however, act 405, 406, or both, can be performed (e.g., with the apparatus shown in FIGS. 1 and 2) by turning off water pump 198 (e.g., circulating domestic hot water).

In a number of embodiments, in at least one of the first mode or the second mode, the method (e.g., 400) includes managing the refrigerant charge, for example, in accordance with one of the methods described above (e.g., 300). In certain embodiments, the first mode of operation, the second mode of operation, or both, may be as previously described, for instance. Even further, in a number of embodiments, during the method (e.g., 400) of heating and cooling the space, the rejecting of heat to the outdoor air or to a heat source/sink (e.g., in act 403 or 405) is accomplished using the outdoor heat exchanger (e.g., 170), the extracting of heat from the outdoor air or from the heat source/sink (e.g., in act 402, 404, or 406) is accomplished using the outdoor heat exchanger (e.g., 170), the heating of water (e.g., the domestic hot water) is accomplished using the water heat exchanger (e.g., 190), or a combination thereof, as examples. Even further still, in various embodiments, the cooling of the space (e.g., in act 401, 403, or 405) is accomplished using the indoor heat exchanger (e.g., 180), the heating the space (e.g., in act 404 or 406) is accomplished using the indoor heat exchanger (e.g., 180), or both.

Further embodiments include various heat pumps (e.g., 100) that heat or cool a space and that also heat water. Such a heat pump can include, for example, an outdoor heat exchanger (e.g., 170) that transfers heat between refrigerant and outdoor air or a heat source/sink, an indoor heat exchanger (e.g., 180) that transfers heat between the refrigerant and indoor air, and a water heat exchanger (e.g., 190) that transfers heat from the refrigerant to water, such as domestic hot water. Further, such embodiments can include, as further examples, a compressor (e.g., 160), at least one expansion device (e.g., 175, 185, or both), and a digital controller (e.g., 130), for instance. Moreover, in a number of embodiments, the digital controller can include, for example, programming instructions (e.g., 135) to manage refrigerant charge, for instance, in accordance with a method described herein.

Various methods include one or more acts of manufacturing, obtaining or providing certain structure described herein, as other examples. Examples include an act of manufacturing, obtaining or providing a heat pump (e.g., 100) that heats and cools a space (e.g., within a building) and that also heats water (e.g., domestic hot water). A number of embodiments include an act of manufacturing, obtaining or providing an improved system to manage refrigerant charge or a heat pump having such a system. Certain embodiments include one or more acts of manufacturing, obtaining or providing an outdoor heat exchanger (e.g., 170) that transfers heat between refrigerant and outdoor air or a heat source/sink, manufacturing, obtaining or providing an indoor heat exchanger (e.g., 180) that transfers heat between the refrigerant and indoor air, and manufacturing, obtaining or providing a water heat exchanger (e.g., a domestic hot water heat exchanger, for instance, 190) that transfers heat from the refrigerant to water. Further, some embodiments include one or more acts of manufacturing, obtaining or providing a compressor (e.g., 160), manufacturing, obtaining or providing an outdoor expansion device (e.g., 175), manufacturing, obtaining or providing an indoor expansion device (e.g., 185), manufacturing, obtaining or providing a refrigerant management valve (e.g., 150), manufacturing, obtaining or providing a reversing valve (e.g., 140), manufacturing, obtaining or providing various refrigerant conduits, or a combination thereof, as examples.

Further still, a number of embodiments include one or more acts of manufacturing, obtaining or providing a first refrigerant conduit (e.g., 101) connecting an outdoor heat exchanger (e.g., 170) to an outdoor expansion device (e.g., 175), manufacturing, obtaining or providing a second refrigerant conduit (e.g., 102) connecting an indoor heat exchanger (e.g., 180) to an indoor expansion device (e.g., 185), manufacturing, obtaining or providing a third refrigerant conduit (e.g., 103) connecting the outdoor expansion device (e.g., 175) to the indoor expansion device (e.g., 185), or a combination thereof, for example. Moreover, particular embodiments include, for instance, one or more of acts of manufacturing, obtaining or providing a fourth refrigerant conduit (e.g., 104) connecting a discharge port (e.g., 164) on a compressor (e.g., 160) to a water heat exchanger or domestic hot water heat exchanger (e.g., 190), manufacturing, obtaining or providing a fifth refrigerant conduit (e.g., 105) connecting the water heat exchanger or domestic hot water heat exchanger (e.g., 190) to a refrigerant management valve (e.g., 150), manufacturing, obtaining or providing a sixth refrigerant conduit (e.g., 106) connecting the refrigerant management valve (e.g., 150) to a reversing valve (e.g., 140), or a combination thereof. Further, some methods include one or more of the acts of manufacturing, obtaining or providing a seventh refrigerant conduit (e.g., 107) connecting the reversing valve (e.g., 140) to the outdoor heat exchanger (e.g., 170), manufacturing, obtaining or providing an eighth refrigerant conduit (e.g., 108) connecting the reversing valve (e.g., 140) to the indoor heat exchanger (e.g., 180), manufacturing, obtaining or providing a ninth refrigerant conduit (e.g., 109) connecting the refrigerant management valve (e.g., 150) to a refrigerant conduit, for instance, the third refrigerant conduit (e.g., 103), manufacturing, obtaining or providing a tenth refrigerant conduit (e.g., 110 connecting the reversing valve (e.g., 140) to an inlet port (e.g., 162) on the compressor (e.g., 160), or a combination thereof, for example.

Various embodiments of the subject matter described herein include various combinations of the acts, structure, components, and features described herein, shown in the drawings, or known in the art. Moreover, certain procedures may include acts such as obtaining or providing various structural components described herein, obtaining or providing components that perform functions described herein. Furthermore, various embodiments include advertising and selling products that perform functions described herein, that contain structure described herein, or that include instructions to perform functions described herein, as examples. Such products may be obtained or provided through distributors, dealers, or over the Internet, for instance. The subject matter described herein also includes various means for accomplishing the various functions or acts described herein or apparent from the structure and acts described.

What is claimed is:

1. A method of managing refrigerant charge in a heat pump that heats or cools a space and that also heats water, the heat pump comprising an outdoor heat exchanger that transfers heat between refrigerant and outdoor air or a heat source/sink, an indoor heat exchanger that transfers heat between the refrigerant and indoor air, a water heat exchanger that transfers heat from the refrigerant to water, a compressor, and at least one expansion device, the method comprising, in any order except where a particular order is explicitly indicated, at least the acts of:

during conditions under which a particular heat exchanger of the heat pump is not needed for transferring heat, delivering refrigerant gas to the particular heat exchanger and driving liquid refrigerant out of the particular heat exchanger and through the at least one expansion device;

while the refrigerant gas is in the particular heat exchanger, isolating the particular heat exchanger against additional refrigerant flowing into the particular heat exchanger; and while the particular heat exchanger is isolated against additional refrigerant flowing into the particular heat exchanger, operating the heat pump, including running the compressor;

wherein the act of driving liquid refrigerant out of the particular heat exchanger comprises monitoring at least one of: compressor discharge temperature, compressor discharge pressure, or duration of the act of driving liquid refrigerant out of the particular heat exchanger; and the act of driving liquid refrigerant out of the particular heat exchanger is terminated when at least one of: the compressor discharge temperature exceeds a predetermined compressor discharge temperature threshold, the compressor discharge pressure exceeds a predetermined compressor discharge pressure threshold, or the duration of the act of driving liquid refrigerant out of the particular heat exchanger exceeds a predetermined duration of the act of driving liquid refrigerant out of the particular heat exchanger.

2. The method of claim 1 wherein:

the particular heat exchanger is the outdoor heat exchanger;

the act of delivering refrigerant gas to the particular heat exchanger and driving liquid refrigerant out of the particular heat exchanger comprises, during conditions under which the outdoor heat exchanger is not needed for transferring heat, delivering refrigerant gas to the outdoor heat exchanger and driving liquid refrigerant out of the outdoor heat exchanger;

the act of isolating the particular heat exchanger against additional refrigerant flowing into the particular heat exchanger comprises, while the refrigerant gas is in the outdoor heat exchanger, isolating the outdoor heat exchanger against additional refrigerant flowing into the outdoor heat exchanger; and the act of operating the heat pump comprises, while the outdoor heat exchanger is isolated against additional refrigerant flowing into the outdoor heat exchanger:

heating the water at the water heat exchanger; and cooling the space using the indoor heat exchanger.

3. The method of claim 1 wherein:

the particular heat exchanger is the indoor heat exchanger;

the act of delivering refrigerant gas to the particular heat exchanger and driving liquid refrigerant out of the particular heat exchanger comprises, during conditions under which the indoor heat exchanger is not needed for transferring heat, delivering refrigerant gas to the indoor heat exchanger and driving liquid refrigerant out of the indoor heat exchanger;

the act of isolating the particular heat exchanger against additional refrigerant flowing into the particular heat exchanger comprises, while the refrigerant gas is in the indoor heat exchanger, isolating the indoor heat exchanger against additional refrigerant flowing into the indoor heat exchanger; and the act of operating the heat pump comprises, while the indoor heat exchanger is isolated against additional refrigerant flowing into the indoor heat exchanger:

heating the water at the water heat exchanger; and extracting heat from the outdoor air or from the heat source/sink using the outdoor heat exchanger.

4. The method of claim 1 wherein:

in a first mode of operation:

the particular heat exchanger is the outdoor heat exchanger;

the act of delivering refrigerant gas to the particular heat exchanger and driving liquid refrigerant out of the particular heat exchanger comprises, during conditions under which the outdoor heat exchanger is not needed for transferring heat, delivering refrigerant gas to the outdoor heat exchanger and driving liquid refrigerant out of the outdoor heat exchanger;

the act of isolating the particular heat exchanger against additional refrigerant flowing into the particular heat exchanger comprises, while the refrigerant gas is in the outdoor heat exchanger, isolating the outdoor heat exchanger against additional refrigerant flowing into the outdoor heat exchanger; and the act of operating the heat pump, including running the compressor, comprises, while the outdoor heat exchanger is isolated against additional refrigerant flowing into the outdoor heat exchanger, operating the heat pump, including:

running the compressor;

heating domestic hot water at the water heat exchanger; and cooling the space using the indoor heat exchanger; and in a second mode of operation:

the particular heat exchanger is the indoor heat exchanger;

the act of delivering refrigerant gas to the particular heat exchanger and driving liquid refrigerant out of the particular heat exchanger comprises, during conditions under which the indoor heat exchanger is not needed for transferring heat, delivering refrigerant gas to the indoor heat exchanger and driving liquid refrigerant out of the indoor heat exchanger;

the act of isolating the particular heat exchanger against additional refrigerant flowing into the particular heat exchanger comprises, while the refrigerant gas is in the indoor heat exchanger, isolating the indoor heat exchanger against additional refrigerant flowing into the indoor heat exchanger; and the act of operating the heat pump, including running the compressor, comprises, while the indoor heat exchanger is isolated against additional refrigerant flowing into the indoor heat exchanger, operating the heat pump, including:

running the compressor;

heating domestic hot water at the water heat exchanger; and extracting heat from the outdoor air or from the heat source/sink using the outdoor heat exchanger.

5. The method of claim 1 wherein:

the act of isolating the particular heat exchanger against additional refrigerant flowing into the particular heat exchanger comprises closing a particular electronic expansion valve that is connected to the particular heat exchanger with a first refrigerant conduit; and the act of operating the heat pump comprises keeping the particular electronic expansion valve closed for at least a majority of the act of operating the heat pump.

6. The method of claim 1 wherein the act of isolating the particular heat exchanger against additional refrigerant flowing into the particular heat exchanger comprises actuating a refrigerant management valve located in a refrigerant conduit that connects the water heat exchanger to a reversing valve that is used to switch the heat pump between a heating mode, in which the heat pump heats the space, and a cooling mode, in which the heat pump cools the space.

7. The method of claim 6 wherein the act of isolating the particular heat exchanger against additional refrigerant flowing into the particular heat exchanger comprises closing a particular electronic expansion valve that is connected to the particular heat exchanger with a first refrigerant conduit; and wherein the act of operating the heat pump comprises keeping the particular electronic expansion valve closed for at least a majority of the act of operating the heat pump.

8. The method of claim 7 further comprising an act of adjusting the refrigerant charge, wherein:

the act of adjusting the refrigerant charge takes place after the act of isolating the particular heat exchanger against additional refrigerant flowing into the particular heat exchanger;

the act of adjusting the refrigerant charge takes place during the act of operating the heat pump; and the act of adjusting the refrigerant charge comprises using at least one of the particular electronic expansion valve or the refrigerant management valve to let refrigerant into the particular heat exchanger.

9. The method of claim 8 wherein the act of adjusting the refrigerant charge comprises monitoring refrigerant subcooling at a water heat exchanger outlet and letting refrigerant into the particular heat exchanger if the subcooling at the water heat exchanger outlet exceeds a predetermined subcooling threshold.

10. The method of claim 1 wherein the act of driving liquid refrigerant out of the particular heat exchanger comprises monitoring: compressor discharge temperature, compressor discharge pressure, and duration of the act of driving liquid refrigerant out of the particular heat exchanger; and the act of driving liquid refrigerant out of the particular heat exchanger is terminated when the compressor discharge temperature exceeds a predetermined compressor discharge temperature threshold, the compressor discharge pressure exceeds a predetermined compressor discharge pressure threshold, or the duration of the act of driving liquid refrigerant out of the particular heat exchanger exceeds a predetermined duration of the act of driving liquid refrigerant out of the particular heat exchanger, whichever occurs first.

11. The method of claim 1 wherein, during conditions under which a certain heat exchanger of the heat pump is used as an evaporator, the evaporator being different than the particular heat exchanger, the act of driving liquid refrigerant out of the particular heat exchanger comprises monitoring refrigerant superheat between the evaporator and the compressor, and if the refrigerant superheat between the evaporator and the compressor is less than a predetermined bottom superheat threshold, starting or accelerating an evaporator fan that blows air through the evaporator; and if the refrigerant superheat between the evaporator and the compressor exceeds a predetermined top superheat threshold, stopping or decelerating the evaporator fan that blows air through the evaporator.

* * * * *